US007219894B2

(12) United States Patent
Stewart et al.

(10) Patent No.: US 7,219,894 B2
(45) Date of Patent: May 22, 2007

(54) BOARD GAMES WITH PLAYER-WEARABLE COSTUME COMPONENTS

(75) Inventors: Chip Stewart, Tukwila, WA (US); Jim Keifer, Manhattan Beach, CA (US); Peter MacIver, Huntington Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/269,208

(22) Filed: Nov. 7, 2005

(65) Prior Publication Data

US 2006/0170159 A1 Aug. 3, 2006

Related U.S. Application Data

(60) Provisional application No. 60/626,968, filed on Nov. 10, 2004.

(51) Int. Cl.
*A63F 3/00* (2006.01)

(52) U.S. Cl. ..... 273/236; 273/242; 273/254

(58) Field of Classification Search ..... 273/236, 273/242, 254
See application file for complete search history.

(56) References Cited

U.S. PATENT DOCUMENTS 1,656,943 A 1/1928 Firestone
2,165,891 A 7/1939 Freedman
2,635,881 A 4/1953 Cooney
3,942,800 A 3/1976 Holbrook
3,951,411 A 4/1976 Hill et al.
4,061,335 A 12/1977 Breslow
4,341,385 A 7/1982 Doyle et al.
4,378,941 A 4/1983 Derby
4,569,527 A 2/1986 Rosenwinkel et al.
4,813,680 A * 3/1989 Rudell et al. ..... 273/249
4,993,717 A * 2/1991 Fiske ..... 273/243
5,033,752 A 7/1991 Bunting
5,067,723 A * 11/1991 Yurkovic ..... 273/249
5,662,328 A 9/1997 Pecoy
5,752,700 A * 5/1998 Delzotti ..... 273/243
5,924,695 A 7/1999 Heykoop
6,120,028 A 9/2000 Boyer
6,446,968 B1 9/2002 Koch

* cited by examiner

*Primary Examiner*—Vishu Mendiratta
(74) *Attorney, Agent, or Firm*—Kolisch Hartwell, P.C.

(57) ABSTRACT

Board games may include a game board, player movers, and indicia-bearing tokens and player-wearable costume components including one or more mounting sites to which the tokens may be removably attached. Some embodiments may further include game pieces having indicia indicating one or more of the tokens. Thus, some methods of game play may involve each player attempting to collect a predetermined set of tokens by determining if various game pieces indicate any of the tokens in the set. Other methods may involve concealing the indicia on one or more game pieces, and allowing players to attempt to guess the concealed indicia by the process of elimination.

14 Claims, 4 Drawing Sheets

BOARD GAMES WITH PLAYER-WEARABLE COSTUME COMPONENTS

RELATED APPLICATIONS

This application is based upon and claims priority under 35 U.S.C. § 119(e) to the U.S. Provisional Patent Application No. 60/626,968 entitled "Board Game" and filed on Nov. 10, 2004, the disclosure of which is incorporated herein by reference in its entirety for all purposes.

BACKGROUND AND TECHNICAL FIELD

The present disclosure is directed to board games, and more particularly to board games in which players move movers on a game board and attempt to collect indicia-bearing tokens or markers, which may be attached to player-wearable costume components included with the game. In some embodiments, the tokens resemble jewels, and the costume components include various pieces of play jewelry such as necklaces, rings, and so forth. The costume components may include one or more mounting sites to which a token may be removably attached. Some embodiments may further include game pieces, such as tile or cards, that include indicia indicating one or more of the tokens. Thus, some methods of game play may involve each player attempting to collect a predetermined set of tokens by determining if various game pieces indicate any of the tokens in the set. Other methods may involve concealing the indicia on one or more game pieces, and allowing players to attempt to guess the concealed indicia by the process of elimination.

Examples of games wherein players collect tokens corresponding to jewels or treasure can be found in the disclosures of U.S. Pat. Nos. 1,656,943, 4,569,527, 5,662,328, 5,924,695, and the Parker Brothers game "Caper." Examples of games wherein players determine the identity of concealed cards can be found in the disclosures of U.S. Pat. Nos. 2,165,891, 3,942,800, 6,446,968,and the Parker Brothers game "Clue." All of the aforementioned disclosures are incorporated herein by reference.

DETAILED DESCRIPTION

Figure 1:
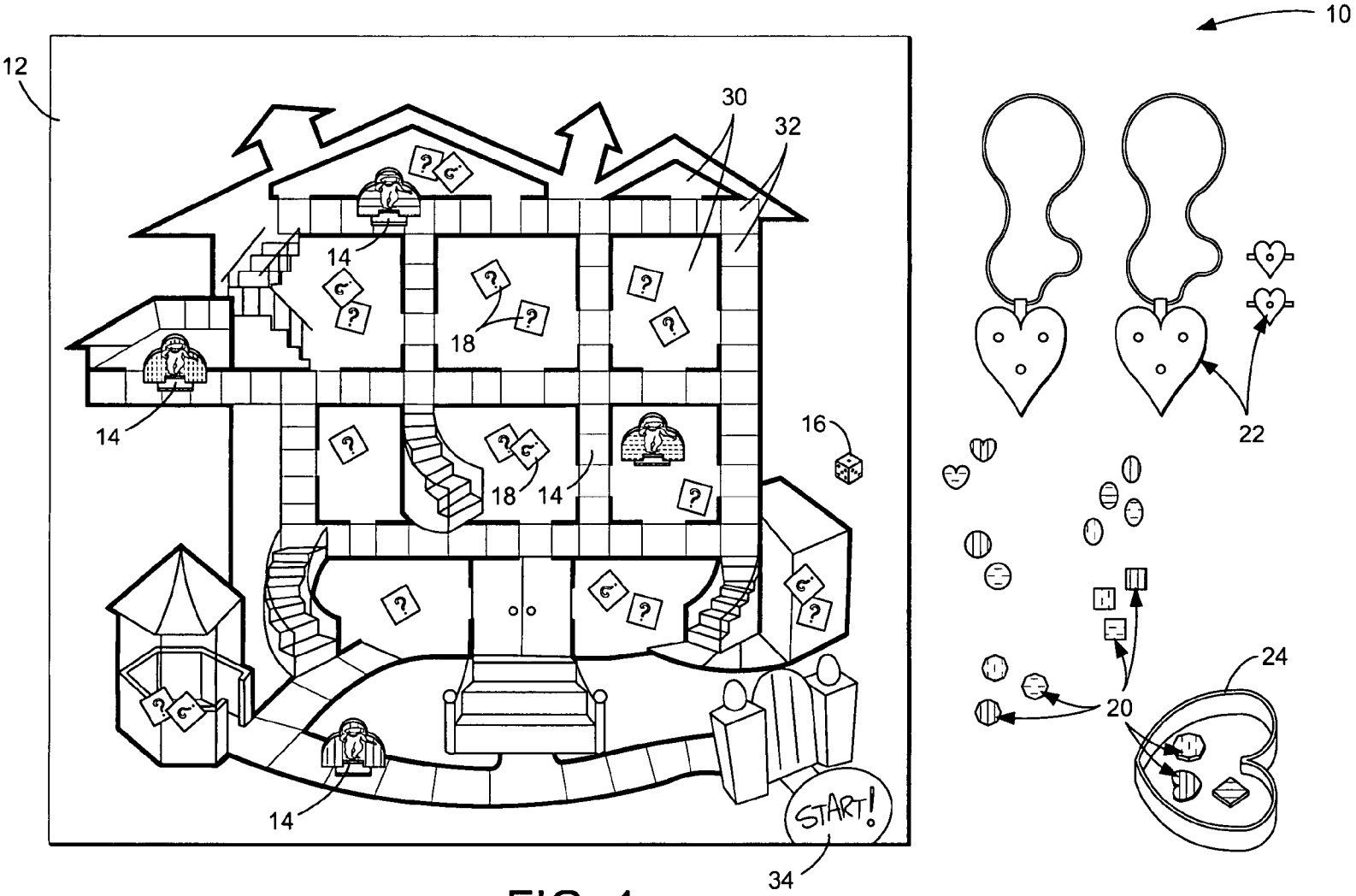
FIG. 1 is a top perspective view showing various components of an exemplary board game, including a game board, several game pieces, some player movers, a die, several player-wearable costume components, a plurality of tokens, and a token container.

The present disclosure provides game components and methods for playing board games in which players attempt to collect a set tokens or markers, which may be attached to player-wearable costume components that are included with the game. For example, in some embodiments, the costume components may take the form of various pieces of play jewelry such as necklaces, rings, and so forth, and the tokens may resemble jewels. In such embodiments, collected jewels may thus be attached to the player-wearable play jewelry, for example to indicate each player's progress in the game.

The costume components may have one or more mounting sites, and the tokens may be adapted to be removably attached the mounting sites by means of any appropriate linkage such as a press fit coupling arrangement (e.g., a hook-and-loop engagement), a releasably interlocking coupling arrangement (e.g., a snap fit mechanism), and/or magnets, adhesives, and so forth. For example, in embodiments that include tokens in the form of play jewels, each may include a small stud projecting from a rear surface of the play jewel. In this example, each costume component (various pieces of play jewelry) may include mounting sites in the form of small holes each sized to receive, and releasably retain, a stud.

The tokens may include distinguishable indicia, for example to differentiate tokens into identifiable sets, with each token of a set including distinguishable indicia common to all tokens of the set. In some methods of game play, such distinguishable indicia may thus allow each player of the game to identify jewels he or she attempts to collect during game play. For example, each token may have a distinguishable color, symbol, and/or any suitable marking. Further, the distinguishable indicia may indicate player affiliation. Thus, for example, tokens with the same color may constitute a set that corresponds to player or team, such that the player (or team of players) affiliated with a color may be attempting to collect the tokens of the same color. The distinguishable indicia optionally may relate the tokens to other game components, such as the player-wearable costume components.

Further, the tokens of each set may themselves be distinguishable from each other; for example, each token of a set may differ in shape, size, and/or other characteristic, from other tokens in the set.

Embodiments of the game may further include a plurality of game pieces, some of which include token indicia indicating one or more tokens, for example by means of a graphic image of a token. Other game pieces may alternatively or additionally include indicia indicating a game action. The game pieces may take the form of tiles, cards, chips, or any suitable structure adapted to selectively conceal the indicia. For example, the game pieces may be tiles with two faces, with one face bearing token indicia and/or game action indicia, and with the other face bearing generic indicia, such that the tiles are indistinguishable when placed "face-down" (that is, with only the generic indicia visible) on a surface. In embodiments in which the tokens take the form of play jewels, the token-indicating game pieces may simply bear an illustration of one of the play jewels. Other game pieces may bear text, icons, or symbols adapted to convey the game action on the game piece.

Other game components may include a game board, player movers adapted to be moved by the players of the game on the game board, one or more dice or a similar movement device to indicate movement on the board, and so forth. In some embodiments, a game board may include a plurality of designated location spaces and a series of pathways interconnecting the location spaces, each pathway consisting of a series of movement spaces. The player movers may bear distinguishable indicia as described above (such as a color, symbol, or otherwise), for example to identify each player mover with a player (or player team) and/or to assist each player in keeping track of his or her progress on the game board.

As mentioned briefly above, some methods of game play suitable for use with the concepts and components discussed herein may involve each player or team attempting to collect a predetermined set of tokens. In some embodiments, players may do this by moving player movers among designated location spaces upon which game pieces have been placed face-down, and determining if the game pieces indicate one or more tokens in the set. More specifically, for example, a player may pick up a game piece after moving his or her player mover to the location space upon which the game piece has been placed, and determine if the game piece indicates a token the player is attempting to collect. If so, the player may affix the corresponding token to a costume component the player is wearing. If not, the player replaces the game piece and considers where to move on his or her next turn.

Other methods of game play may involve concealing the indicia on one or more game pieces, and allowing players to attempt to guess the concealed indicia by the process of elimination. For example, one or more game pieces may be removed from play and the remainder placed on the game board. The players may attempt to deduce the indicia on the removed game pieces by moving player movers as above, looking at the indicia on any game pieces the player movers encounter on the game board, and recording the indicia on the game pieces. If the indicia on all of the game pieces are known to the players, for example, if the game includes a reference card, a checklist, or some other representation of the indicia on the game pieces, the players may use the process of elimination to determine the concealed indicia on the removed game pieces. In such methods, players may cooperate to determine the concealed indicia, or each player or team may keep his or her findings from the other players such that the first player who correctly determines the concealed indicia is the winner.

Some embodiments of the game may incorporate a theme or backstory, for example to enhance play value, to assist player comprehension of the methods and/or rules of game play, and so forth. Such a theme or backstory may be manifested in various ways, such as by the inclusion of thematic indicia in graphic images and/or decorative features adorning the various game components, game component configuration, text included in a set of rules to accompany the game, and so forth.

Figure 7:
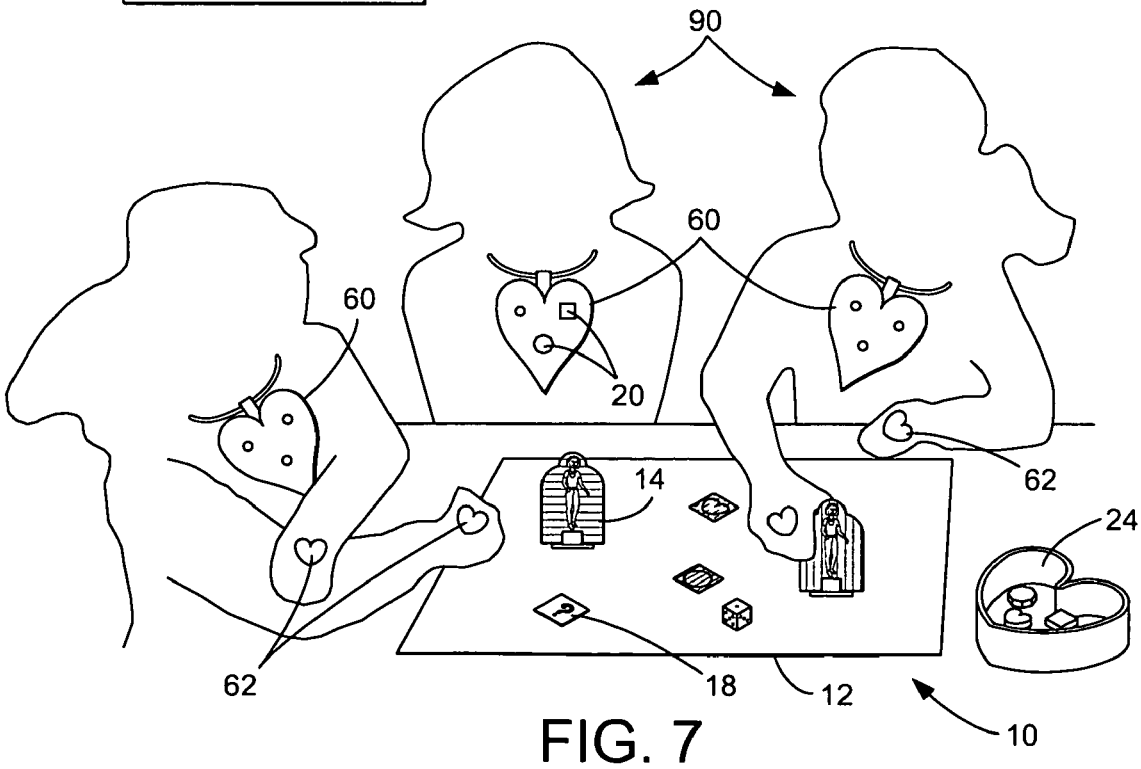
FIG. 7 is an illustration showing three players playing the game of FIG. 1 according to some methods of game play, and wearing various player-wearable costume components.

An exemplary embodiment of the game is described herein with reference to the components illustrated in FIGS. 1-6, and a method of play for use with the exemplary embodiment is illustrated in FIG. 7. As shown, the exemplary embodiment illustrates some of the examples suggested above in that the player-wearable costume components are shown as pieces of play jewelry, the tokens as play jewels, the game pieces as tiles, and so forth.

Thus, referring first to FIG. 1, components of a board game 10 are shown to include a game board 12, a plurality of player movers 14, a die 16, several game pieces 18, and some tokens 20. Game pieces 18 and player movers 14 are shown positioned on the game board; thus, the illustration presented in FIG. 1 may represent a game in progress. Several player-wearable costume components 22 are shown to the side of the game board, as is a token container 24 in the form of a jewel box, which may be used to hold tokens and/or other game components not in use during game play.

The game board 12 can be seen to include a plurality of location spaces 30, interconnected by a plurality of movement spaces 32 that are arranged to collectively form a series of pathways. In the illustrated embodiment, the location spaces resemble the rooms and other features of a house or mansion, and the pathways formed by the movement spaces resemble hallways, staircases, and other routes that thread between and among the various rooms and surrounding grounds of the mansion. One or more movement spaces adjacent a location space may indicate that the movement space serves as an entry or exit point for the location space, allowing a player mover to be moved from a movement path into a room, and vice versa. Also, one of the movement spaces of the game board is shown to include indicia designating the space as a start space 34.

Figure 2:
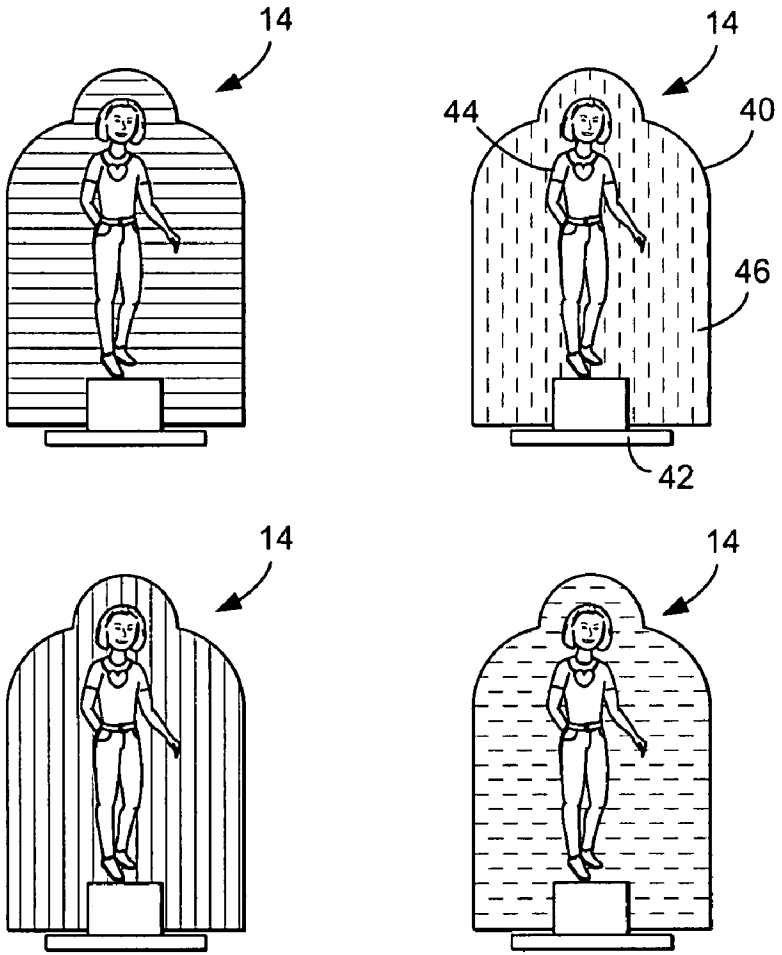
FIG. 2 is a front view of four player movers suitable for use with the board game of FIG. 1.

Player movers 14 are also shown in FIG. 2, and can be seen to each consist of a generally vertical cutout 40 fitted into a base 42. The cutout is sized and shaped to resemble a person, and is marked with an illustrated FIG. 44 resembling a young girl. As can also be seen with reference to FIG. 1, the base is sized and shaped to fit generally within movement spaces 32 and location spaces 30 on game board 12. Each player mover thus resembles a person moving through the mansion represented on the game board. In play, each player mover may be used to represent a different player or team, and thus may include differentiable player affiliation indicia 46 such as a color. Each player mover is thus shown to be colored differently, by means of different styles of shading lines (however, the individual styles of shading lines do not indicate any particular color).

Player movers may be moved among the various location spaces by means of die 16, which may be marked with numerical indicia or other indicia, for example an icon or symbol representing a location on the game board, a type of movement, and so forth. Also, although a single, six-sided die is shown, other embodiments may include multiple dice, spinners, or other suitable devices adapted to determine movement.

In FIG. 1 several location spaces 30 are shown to include one or more game pieces 18. As mentioned above, in some exemplary methods of game play, players may attempt to collect a set of tokens 20, such as by moving the player movers on the game board among the location spaces, trying to find the game pieces that indicate the tokens each player is attempting to collect.

Figure 3:
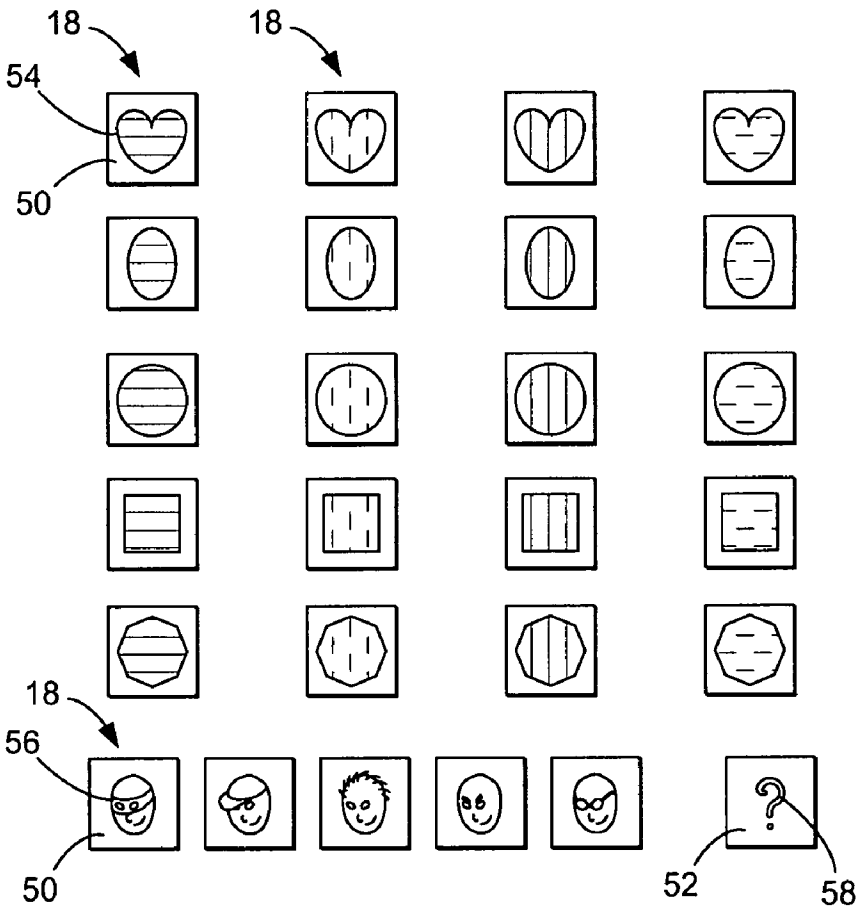
FIG. 3 shows an exemplary set of game pieces suitable for use with the board game of FIG. 1.

The tokens of the exemplary embodiment represent play jewels, and thus the game pieces may include indicia representing the various jewels. FIG. 3 shows an exemplary set of game pieces 18 in greater detail. The game pieces are shown to be in the form of flat tiles, sized and shaped such that one or more may be placed in at least some of the location spaces on the game board.

Game pieces 18 are thus shown to include a first face 50 and a second face 52. First face 50 of some of the game pieces bear token indicia 54, shown as graphical illustrations of jewels of various colors and shapes, corresponding to tokens 20. Other game pieces 18 have a first face that bears game action indicia 56, shown in FIG. 3 as a graphical illustration of a jewel thief. An exemplary second face 52 of a tile is shown to bear generic game indicia 58, indicated to be a stylized question mark.

Although the various indicia are shown as jewels, jewel thieves, and question marks, many variations are possible and are considered to be within the scope of the disclosure. The indicia used to represent the tokens, game actions, and so forth, may include any combination of suitable markings, and optionally may relate to a theme or backstory incorporated into the board game; for example, if an embodiment is based around the theme of pirates and treasure, the various game pieces might include illustrations of various coins, ships, pirates, and so forth; a space-themed game might include indicia on the game pieces representing space ships, planets, and so forth. Further, second face 56 may be left blank, decorated with some other generic indicia and/or trade dress, or marked in some manner to make the tiles indistinguishable when viewed from the second face. Also, the game pieces may take any suitable configuration that allows some of the indicia to be concealed from view, such as placing a tile face-down on a surface; for example, the game pieces may include foldable structure, one or more faces that may be selectively covered and/or revealed, and so forth.

In the illustrated embodiment, the game pieces represent five different jewel thieves and four of each of five different jewel types. The jewel types are distinguishable by shape (heart, circle, ellipse, etc.), and each jewel of a given type is distinguishable by color. Each "jewel tile" thus represents a jewel of a distinguishable shape and color (for example, a pink heart, a blue circle, a purple ellipse, etc.). Also, as shown, the colors of the jewels on the game pieces correspond to the colors of the player movers. Thus, as explained in greater detail below, each set of jewel tiles indicating jewels of the same color may represent a set of jewels that must be collected by a player controlling the player mover of the corresponding color. Additionally, each jewel thief is indicated to be visually distinguishable, which may indicate different game actions, may be a decorative feature, and so forth.

In the illustrated embodiment, the game pieces 18 represent a complete set of game pieces suitable for use in the methods of game play explained below. Thus, in the illustrated embodiment, each game piece is unique. Of course, other embodiments may include multiple copies of some game pieces, and such variations are considered to be within the scope of this disclosure.

FIG. 1 also shows an assortment of tokens 20, individually represented as play jewels of different colors and shapes, corresponding to the token indicia indicated on some game pieces 18. As such, the tokens are shown to have the different shapes and colors presented on the game pieces. Also, although not shown, the illustrated embodiment includes a set of game pieces consisting of all of the jewels indicated on the exemplary set of game pieces 18 in FIG. 3. Thus, in the illustrated embodiment, each token is unique, and there is a 1:1 correspondence between the jewel-indicating tiles and the play jewels; accordingly, the set of tokens of the illustrated embodiment includes four colors of each of five different jewel types. However, in other embodiments, the correspondence between the game pieces and tokens may be varied.

Figure 4:
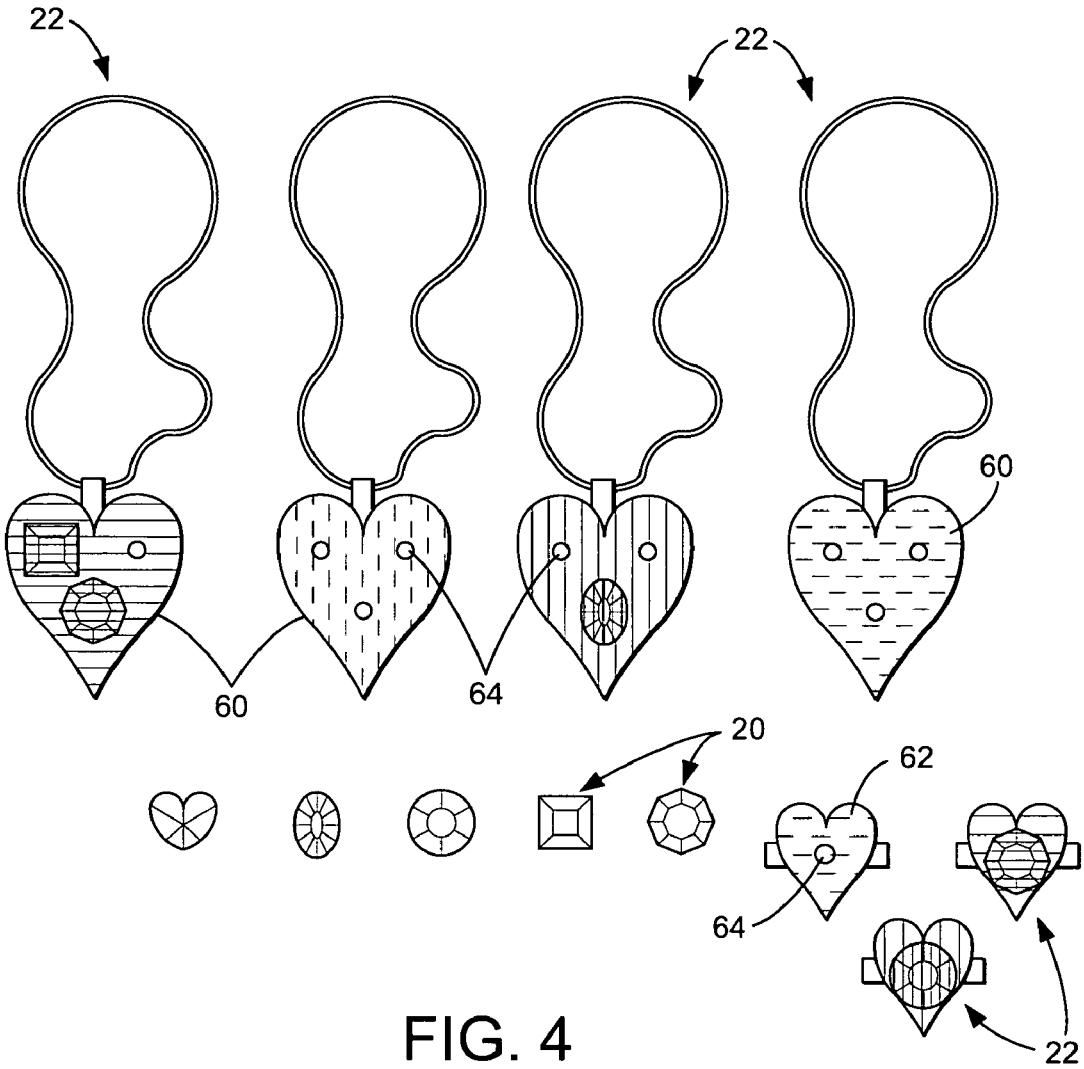
FIG. 4 shows the player-wearable costume components of the board game of FIG. 1, shown as several pieces of play jewelry, and a plurality of tokens in the form of play jewels.

A representative assortment of tokens 20 is also shown in FIG. 4, which also depicts several player-wearable costume components 22 in the form of pieces of player-wearable play jewelry such as necklaces 60 and rings 62. Each costume component 22 includes one or more mounting sites 64, at which the tokens may be attached. Specifically, in the exemplary embodiment, each necklace 60 includes three mounting sites, and each ring 62 includes one mounting site. Further, each costume component is shown to include player affiliation indicia in the form of a color, which may indicate a player affiliation and/or correspondence with one of player movers 14.

The illustrated embodiment includes three pieces of player-wearable play jewelry per player: one necklace and two rings. Thus, a total of five play jewels may be attached to the set of play jewelry of each player. Although not shown, the various costume components may include rule indicia indicating which tokens may be attached to a mounting site, an order in which the tokens must be attached, and so forth, or such choices may be left to player preference.

Figure 5:
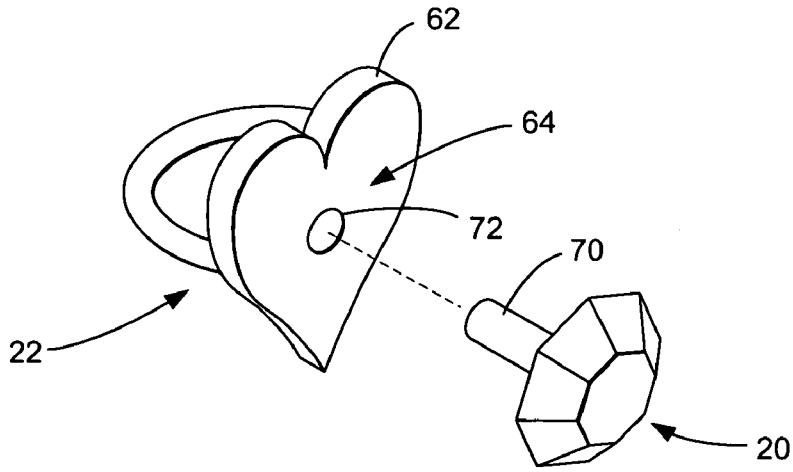
FIG. 5 is a three-dimensional view showing an exemplary manner in which a token may be attached to a player-wearable costume component.
Figure 6:
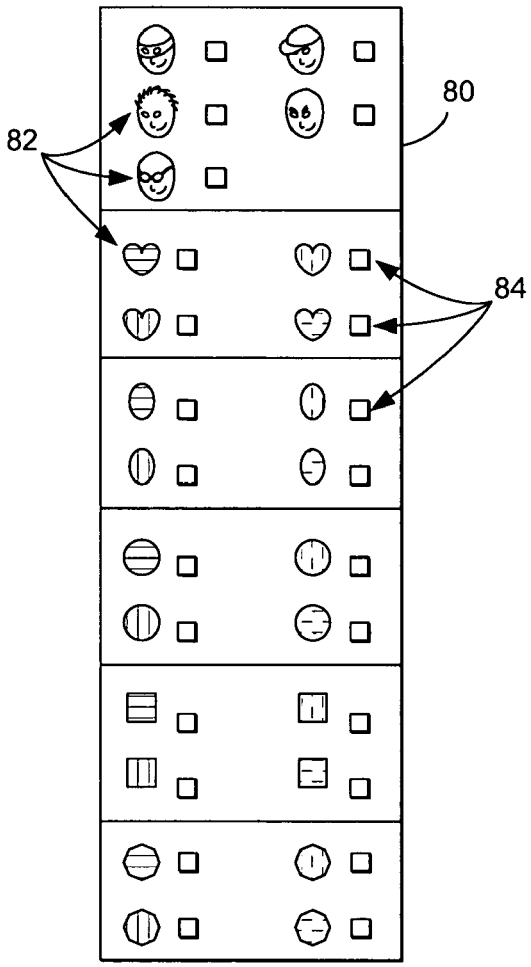
FIG. 6 shows an exemplary checklist suitable for use, in some methods of game play, with the board game of FIG. 1.

In FIG. 4, two necklaces are shown with one or more play jewels attached, and two rings are each shown with a play jewel. FIG. 5 illustrates one manner in which tokens may be attached the mounting sites of the costume components: the token in FIG. 5 includes a small stud 70 projecting from a rear side of the token, sized and shaped to be received and retained in a corresponding hole 72 of mounting site 64 of the costume component (ring 62), in a snap fit. However, any suitable releasably interlocking coupling arrangement may be used. Optionally, a press fit coupling arrangement may be used, such as a hook-and-loop engagement, or any suitable linkage, including magnetic, mechanical, and/or adhesive linkages.

Also, in the illustrated embodiment, the play jewels may be attached to any piece of play jewelry. However, in some embodiments, the various mounting sites of the costume components may be individually configured to allow only correspondingly configured tokens to be attached thereto. For example, a tokens including a given player affiliation indicia may be adapted to be attached only to a costume component that includes corresponding player affiliation indicia.

As mentioned previously, the illustrated embodiment includes a set of twenty-five tiles, twenty each having a first face indicating a jewel with a unique color and shape combination (specifically, four different colors of five different shapes), and five each having a first face with indicating a unique jewel thief. In embodiments in which players attempt to determine the indicia on one or more selected game pieces, a visual reference of all of the indicia may be used, such as checklist 80 in FIG. 6. As shown, each jewel thief and each jewel presented in the set of tiles of FIG. 3 is included on checklist 80 as a small icon 82. Checklist 80 also includes a small check box 84 adjacent each icon, for example to allow a player to record whether or not a particular jewel has been found during game play.

Two exemplary methods of game play utilizing the concepts and components discussed above are outlined in the paragraphs below. The games may be played by multiple players, each of which chooses a player mover for movement on the game board. As described in greater detail below, the first method involves collecting jewels to attach to the player-wearable play jewelry. The second method involves attempting to guess the jewel and the jewel thief on two tiles that are concealed from view by the players.

EXAMPLE 1

In the first method, the tiles with play jewel indicia are mixed and arranged on the game board prior to game play such that a predetermined number of such tiles are placed on at least some of the location spaces on game board 12. The number of tiles, and the particular location spaces, may be designated in a set of rules that accompany the game. The tiles are placed face down in location spaces 30 so that the tiles are indistinguishable from each other, the play jewels are placed in the jewel box, and pieces of play jewelry 60, 62 are distributed among the players according to player mover color. The pieces of play jewelry may be worn by the players during the game.

Play proceeds with players taking turns rolling die 16 and moving their player movers from start space 34 among the various rooms and surrounding grounds of the mansion. When a player moves a mover into a location space that includes tiles, one tile is selected and turned over. If the tile indicates a play jewel that corresponds in color to the player's player mover, the play jewel corresponding to that depicted on the tile is removed from the jewel box and attached to a piece of the player's play jewelry. If the tile indicates a play jewel of a different color, the tile is replaced.

FIG. 7 shows three players 90 playing game 10 according to this exemplary method: each player 90 is shown to be wearing various player-wearable costume components such as necklaces 60 and rings 62, some of the mounting sites of which are shown to have one or more tokens 20 attached, while moving player movers 14 on game board 12.

Play continues in this manner, with players attempting to collect enough jewels of a particular color to attach to all of the mounting sites on their pieces of play jewelry; that is, each player attempts to collect five jewels of the same color. The player who completes his or her collection first may be declared the winner.

As briefly mentioned above, several aspects of this exemplary method of game play may be modified and reflected in a set of rules to accompany the game. The rules may thus be configured to provide a game with a desired degree of complexity or difficulty, adapting the game to players of a predetermined age range. For example, some embodiments may require that each player must collect play jewels in a particular order, that jewels of any color may be collected, that tiles are placed in a predetermined configuration on the game board, and so forth.

Optionally, the jewel thief tiles may be included in some embodiments of the game played according to this exemplary method. For example, the jewel thief tiles may be mixed together with, and distributed among, the jewel tiles at the beginning of the game. During play, if a tile selected by a player is revealed to be a jewel thief tile, the player who selected the tile may be required to perform a game action, such as returning a collected play jewel back to the jewel box, moving the player's player mover to a starting space, or the like, according to a set of rules.

EXAMPLE 2

In the second method, a randomly-chosen jewel tile and a randomly-chosen jewel thief tile are removed from the remainder of the cards and placed, face down, in a predetermined location space, such as an "attic" room of the mansion depicted on the game board. The remainder are shuffled and arranged on the game board according to the rules.

Play proceeds with players taking turns rolling the die and moving their player movers from a designated start space among the various rooms and surrounding grounds of the mansion. When a player moves a mover into a location space containing tiles, one card is selected and turned over. The jewel or jewel thief indicia on the card is noted and the player may check a box on the checklist that corresponds to the chosen tile.

Play continues in this manner, with players attempting to deduce the particular jewel and jewel thief on the tiles in the "attic" room by the process of elimination.

As with the first example, this exemplary method of game play may be modified and reflected in a set of rules to accompany the game. For example, some embodiments may have a competitive aspect, allowing each player to record only the tiles that player chooses: a player peeks at the indicia on a chosen card, records the indicia on that player's own checklist, and replaces the tile. In these embodiments, the first player to correctly guess the indicia on the tiles in the "attic" room may be declared the winner. Alternatively, some embodiments may have a cooperative aspect, allowing players to combine efforts by recording each tile revealed, for example on a collective checklist.

What is claimed is:

1. A game for at least two players, the game comprising:

a game board;

a plurality of player movers adapted to be moved on the game board, each player mover including distinguishable player affiliation indicia;

a plurality of player-wearable costume components, each player-wearable costume component including one or more mounting sites;

a plurality of sets of tokens, each token adapted to be removably mounted to a mounting site of a player-wearable costume component, and the tokens of each set being visually distinguishable from the other tokens in the same set and including player affiliation indicia such that each set of tokens visually corresponds with a player mover;

a set of game pieces, each game piece including token indicia adapted to visually indicate a token in one of the plurality of sets of tokens; and a set of rules for game play.

2. The game of claim 1 further including an additional set of game pieces, each game piece of the additional set including game action indicia adapted to indicate a different game action.

3. The game of claim 1 wherein the game pieces are cards.

4. The game of claim 1 wherein each token is adapted to be removably mounted to a mounting site of a player-wearable costume component in a press fit coupling arrangement.

5. The game of claim 1 wherein each token is adapted to be removably mounted to a mounting site of a player-wearable costume component in a releasably interlocking coupling arrangement.

6. The game of claim 1 wherein the plurality of player-wearable costume components includes pieces of player-wearable play jewelry.

7. The game of claim 6 wherein the pieces of player-wearable play jewelry include a jewelry set for each player, each jewelry set further including a necklace and two rings.

8. The game of claim 7 wherein each necklace includes three mounting sites and wherein each ring includes one mounting site.

9. The game of claim 1 wherein the plurality of tokens includes a plurality of play jewels.

10. A method of playing a game that includes a game board with a plurality of predetermined locations, a plurality of player movers adapted to be moved on the game board, a plurality of player-wearable costume components, each costume component including one or more mounting sites, a plurality of sets of tokens each including distinguishable player affiliation indicia such that each set of tokens visually corresponds with a player mover, with each token adapted to be removably mounted to a mounting site of a player-wearable costume component, a plurality of game pieces each including token indicia indicating a token, and a set of rules, the method comprising:

distributing to each player a player-wearable costume component and a player mover;

placing the game pieces on one or more of the predetermined locations on the game board such that the token indicia on the same pieces is not visible;

moving a player's player mover on the game board to a predetermined location upon which a same piece that indicates a token with player affiliation indicia corresponding to the player mover has been placed;

displaying the token indicia on a same piece to the player;

removably mounting the indicated token to the player's player-wearable costume component; and wearing the player-wearable costume component.

11. The method of claim 10, wherein the action of moving player movers on the game board is repeated until a game-ending event is reached.

12. The method of claim 11 wherein the rules provide that a game ending event is reached when one player has collected a predetermined set of tokens.

13. The method of claim 10, further including assessing a penalty upon the occurrence of a predetermined game event.

14. The method of claim 13 wherein the rules provide that a penalty is removing a token from a player-wearable costume component.

* * * * *